US006060967A

United States Patent [19]

Asada

[11] Patent Number: 6,060,967

[45] Date of Patent: May 9, 2000

[54] SURFACE MOUNT FILTER WITH DIELECTRIC BLOCK THROUGH HOLES CONNECTED TO STRIPLINES GROUNDED BY CAPACITORS

[75] Inventor: Naoyuki Asada, Yamaguchi, Japan

[73] Assignee: Sumitomo Metal (SMI) Electronics Inc., Yamaguchi, Japan

[21] Appl. No.: 09/153,068

[22] Filed: Sep. 15, 1998

[30] Foreign Application Priority Data

Sep. 18, 1997 [JP] Japan ..... 9-253065

[51] Int. Cl.[7] ..... H01P 1/202; H01P 1/203

[52] U.S. Cl. ..... 333/202; 333/206

[58] Field of Search ..... 333/202, 204, 333/206, 207, 222

[56] References Cited

U.S. PATENT DOCUMENTS

| | | | |
|---|---|---|---|
| 5,304,967 | 4/1994 | Hayashi | 333/207 X |
| 5,345,202 | 9/1994 | Kobayashi et al. | 333/206 |
| 5,374,910 | 12/1994 | Yamagata | 333/246 X |

FOREIGN PATENT DOCUMENTS

| | | | |
|---|---|---|---|
| 3-178202 | 8/1991 | Japan | 333/202 |
| 3-284001 | 12/1991 | Japan | 333/202 |

OTHER PUBLICATIONS

Japanese Publication No. 05–055810, Published Mar. 5, 1993, by Yamashita Kazuo et al., "Dielectric Filter", 2 pages.

Japanese Publication No. 05–283907, Published Oct. 29, 1993, by Imaizumi Tatsuya et al., "Strip Line Type Filter", 1 page.

*Primary Examiner*—Benny Lee
*Assistant Examiner*—Barbara Summons
*Attorney, Agent, or Firm*—Wenderoth, Lind & Ponack, L.L.P.

[57] ABSTRACT

Using a conventional surface mount filter, it is difficult to miniaturize as the filter characteristics, especially a harmonic rejection characteristic at a fundamental frequency is made favorable, and it is also difficult to regulate the filter characteristics after mounting. In the present invention, plural through holes coated with conductive films are formed on a dielectric block having a high dielectric constant and external electrodes are formed over almost all of the outer surfaces of the dielectric block, except one side surface thereof, while a conductive film is formed on almost all of one main surface of a low dielectric constant substrate, and plural striplines are formed on the other main surface thereof. The rear portions of the striplines and the conductive films in the through holes are electrically connected, while the front portions of the striplines are grounded through chip capacitors.

8 Claims, 5 Drawing Sheets

SURFACE MOUNT FILTER WITH DIELECTRIC BLOCK THROUGH HOLES CONNECTED TO STRIPLINES GROUNDED BY CAPACITORS

BACKGROUND OF THE INVENTION

1. Field of the Invention

The present invention relates to a surface mount filter and, more particularly, to a surface mount filter used as a part of small equipment such as a cellular phone and a cordless telephone for radio communication using a microwave frequency band.

2. Description of the Relevant Art

A surface mount filter with the following characteristics has been widely known. Its construction comprises external I/O terminals on surfaces of a dielectric block and plural striplines formed inside the dielectric block. The space between the striplines varies along the length direction, and one end of each stripline is open while the other end is electrically connected with the external electrodes.

FIG. 1 comprise diagrammatic views of a conventional surface mount filter of the above kind (Japanese Kokai No. 05-55810), where FIG. 1(*a*) is a perspective diagram showing the inside of the filter and FIG. 1(*b*) is a perspective view showing the filter mounted on a printed circuit board.

Two dielectric blocks 41 are formed from a material having a high dielectric constant $\epsilon$ in the shape of a rectangular parallelepiped board, respectively, and are joined. On the top surface 41*b*, bottom surface 41*c*, rear surface 41*d*, and side surfaces 41*e* and 41*f* of the joined dielectric block 41, external electrodes 42*b*–42*f* made of a conductive material and input/output terminals 46*a* and 47*a* are formed.

On the top surface of the lower dielectric block 41. striplines 43 and 44 made of a conductive material are formed almost in the shape of a hook. The stripline front portions 43*a* and 44*a* are extended in parallel to the front surface 41*a* (open end portion) of the dielectric block 41. On the other hand, the stripline rear portions 43*b* and 44*b* are elongated in parallel and are connected to a rectangular connecting conductor 45*a*, which is connected to the external electrodes 42*d*, 42*e*, and 42*f*. Here, the relationship of a distance $d_1$ between the stripline front portions 43*a* and 44*a* with the distance $d_2$ between the stripline rear portions 43*b* and 44*b* is $d_1>d_2$.

The first ends of input/output lines 46*b* and 47*b* are connected to prescribed places of the striplines 43 and 44, while the second ends of the input/output lines 46*b* and 47*b* are connected to the input/output terminals 46*a* and 47*a*, respectively. Two connecting conductors 45*b* are formed in the shape of elongations of the external electrodes 42*e* and 42*f* in the vicinities of both left and right ends of the dielectric block 41, in parallel with the stripline front portions 43*a* and 44*a*. The lower filter 40*a*, includes the dielectric block 41, external electrodes 42*c*–42*f*, striplines 43 and 44, input/output terminals 46*a* and 47*a*, input/output lines 46*b* and 47*b*, and associated parts, while the upper filter 40*b* includes the dielectric block 41, external electrodes 42*b* and 42*d*–42*f*, striplines 43 and 44, input/output terminals 46*a* and 47*a*, input/output lines 46*b* and 47*b*, and associated parts. A surface mount filter 40 comprises the lower filter 40*a* and the upper filter 40*b*.

In the manufacture of the surface mount filter 40 having the above construction, a conductive paste (Ag or Cu paste) is applied to prescribed places on the lower dielectric block 41 and is baked so as to form the striplines 43 and 44, the external electrodes 42*c*–42*f*, and the like, leading to the preparation of the lower filter 40*a*. At the same time, the upper filter 40*b*, having a plane shape symmetrical to the lower filter 40*a*, is prepared. Then, by bonding the planes of the lower filter 40*a* and the upper filter 40*b*, on which the striplines 43 and 44 are formed, to each other, the surface mount filter 40 is manufactured.

By connecting the external electrode 42*c* to a ground electrode 52 formed on the surface of a printed circuit board body 51, while the input/output terminals 46*a* and 47*a* are connected to input/output signal lines 53 and 54 through connecting terminals 55, respectively, the surface mount filter 40 is mounted onto a printed circuit board 50.

FIG. 4 is a schematic circuit diagram showing an equivalent circuit for the surface mount filter 40. Inductances $L_1$ comprise the dielectric block 41 and the stripline front portion 43*a* or 44*a*. To the first ends of the inductances $L_1$ are connected capacitances C formed between the stripline front portion 43*a* or 44*a* and the connecting conductor 45*b*. The capacitances C are connected to the ground electrode 52 through the external electrodes 42*e* or 42*f*, and 42*c*. On the other hand the first ends of inductances $L_2$ comprising the stripline rear portion 43*b* or 44*b* are connected to the second ends of the inductances $L_1$, while the second ends of the inductances $L_2$ are connected to the ground electrode 52 through the connecting conductor 45*a* and the external electrodes 42*d*, 42*e* or 42*f*, and 42*c*.

Between the inductances $L_1$ and $L_2$, the input/output terminal 46*a* or 47*a* is connected through the input/output line 46*b* or 47*b*, respectively. A quarter wavelength resonator 48 includes the stripline 43, external electrodes 42*b*–42*e*, connecting conductors 45*a* and 45*b*, input terminal 46*a*, and associated parts, while a quarter wavelength resonator 49 includes the stripline 44, external electrodes 42*b*–42*d* and 42*f*, connecting conductors 45*a* and 45*b*, output terminal 47*a*, and associated parts. The surface mount filter 40 includes those resonators 48 and 49.

In the surface mount filter 40 having the above construction, the inductances $L_1$ make mutual-inductance coupling (hereinafter, referred to as $M_1$), while the inductances $L_2$ make mutual-inductance coupling (hereinafter, referred to as $M_2$). The distance $d_2$ is shorter than the distance $d_1$, leading to $M_1<M_2$, so that the electromagnetic coupling between the resonators 48 and 49 is ensured by the balance between $M_1$ and $M_2$. Therefore, a filtering treatment of prescribed frequency regions is conducted on microwave signals which are input into the input terminal 46*a* in the resonators 48 and 49, so that only the signals within a prescribed band width are output from the output terminal 47*a*.

As another conventional surface mount filter different from the above-mentioned surface mount filter 40, a surface mount filter having almost the same construction as the lower filter 40*a* shown in FIG. 1 was proposed (Japanese Kokai No. 05-283907). provided that the filter does not include the external electrodes 42*e* and 42*f*, connecting conductors 45*a* and 45*b*, and input/output terminals 46*a* and 47*a*. Another different point from the lower filter 40*a* is that, as prescribed places of an external electrode 42*c* are notched, input/output terminals are formed on the dielectric block bottom surface 41*c* opposed to input/output lines 46*b* and 47*b* so as to cause the input/output terminals and the input/output lines 46*b* and 47*b* to make capacitive coupling. Here, the distance $d_1$ between stripline front portions 43*a* and 44*a* is 5 mm or so, for example.

In the above surface mount filter 40, in order to ensure the electromagnetic coupling between the adjacent resonators 48 and 49, the relationship of the distances $d_1$ and $d_2$ between striplines 43 and 44 is $d_1>d_2$. Since $d_1$ need be larger, miniaturization is difficult. In order to make filter characteristics, especially a harmonic rejection characteristic at a fundamental frequency, more favorable, $M_1$ needs to be set smaller than $M_2$ at a prescribed rate. Accordingly, the distance $d_1$ needs to be larger, and so it becomes more difficult to achieve miniaturization.

Since the striplines 43 and 44, having elaborate shapes and the like, are buried inside the dielectric block 41, the filter is difficult to manufacture. It is impossible to regulate the filter characteristics by modifying the distances between the stripline front portion 43*a* or 44*a* and the connecting conductor 45*b* and the like after mounting the filter on the printed circuit board 50. Since the input/output terminals 46*a* and 47*a* are not formed on the bottom surface 41*c* of the dielectric block 41, the input/output terminals 46*a* and 47*a* cannot be directly connected to the input/output signal lines 53 and 54 on the printed circuit board 50. As a result, it requires much time to connect the input/output terminals 46*a* and 47*a* thereto.

In the above different surface mount filter, striplines 43 and 44 are in exposed positions, so that noise which comes flying from above easily enters the striplines 43 and 44. In order to inhibit the entry of the noise, it is necessary to additionally prepare a shield to cover the filter, leading to a high cost.

SUMMARY OF THE INVENTION

The present invention was developed in order to solve the above problems, and it is one object of the present invention to achieve further miniaturization, as a harmonic rejection characteristic at a fundamental frequency can be made favorable. It is another object of the present invention to enable easy regulation of filter characteristics, as surface mounting onto a printed circuit board can be conducted certainly and easily. It is a further object of the present invention to certainly inhibit the entry of noise signals without preparing a special shield, leading to cost reduction.

In order to achieve the above objects, a surface mount filter (1) according to the present invention comprises a dielectric block with a high dielectric constant having plural through holes coated with conductive films and electrodes formed over almost all the outer surfaces thereof except one side surface on which the first ends of the through holes are located, and a low dielectric constant substrate having a conductive film formed over almost all of one main surface thereof and plural striplines formed on the other main surface thereof and connected to capacitors. The first ends of the striplines and the through holes are electrically connected, while the second ends of the striplines are grounded through the capacitors.

In the surface mount filter (1), plural resonators comprise the conductive films coating the plural through holes inside the dielectric block, the plural striplines formed on the low dielectric constant substrate, and associated parts. The adjacent striplines and the adjacent conductive films make the first mutual-inductance coupling (hereinafter, referred to as $M_1$) and the second mutual-inductance coupling (hereinafter, referred to as $M_2$), respectively. The dielectric block in which the conductive films exist has a high dielectric constant, while the low dielectric constant substrate on which the striplines exist has a low dielectric constant. Accordingly, since the relationship between $M_1$ and $M_2$ is $M_1<M_2$, it is possible to make a strong electromagnetic coupling between the plural resonators without widening the distance between the striplines. As a result, the size can be miniaturized, as the harmonic rejection characteristic at a fundamental frequency can be made favorable.

A surface mount filter (2) according to the present invention is characterized by the first ends of input/output terminals being connected to two of the connection portions of the plural through holes with the plural striplines, while the second ends of the input/output terminals are extended onto a plane of the dielectric block having a high dielectric constant to be connected to a printed circuit board in the surface mount filter (1).

Using the surface mount filter (2), when the low dielectric constant substrate is placed on the printed circuit board with the one main surface of the low dielectric constant substrate facing up, the input/output terminals and the external electrode on the other main surface can be directly connected to interconnections on the printed circuit board. Therefore, the surface mounting can be performed without preparing different connecting terminals. In addition, the plural striplines are shielded against noise which comes flying from above by the conductive film formed on the one main surface, though the striplines are in exposed positions. As a result, the filter characteristics can be easily regulated by processing the plural striplines, while the noise which comes flying from above can be certainly inhibited from entering the plural striplines, so that a different shield need not be prepared, leading to a cost reduction.

A surface mount filter (3) according to the present invention is characterized by the low dielectric constant substrate which is made of a glass epoxy resin, in the surface mount filter (1) or (2).

In the surface mount filter (3), the low dielectric constant substrate is easily molded and processed, and a unit price thereof is low compared with the dielectric block. As a result, the manufacture cost can be reduced, as the filter characteristics can be easily and certainly regulated.

DETAILED DESCRIPTION OF THE INVENTION

The preferred embodiments of the surface mount filter according to the present invention are described below by reference to the Figures. Here, the same marks are affixed to component parts having the same functions as conventional ones.

Figure 1A:
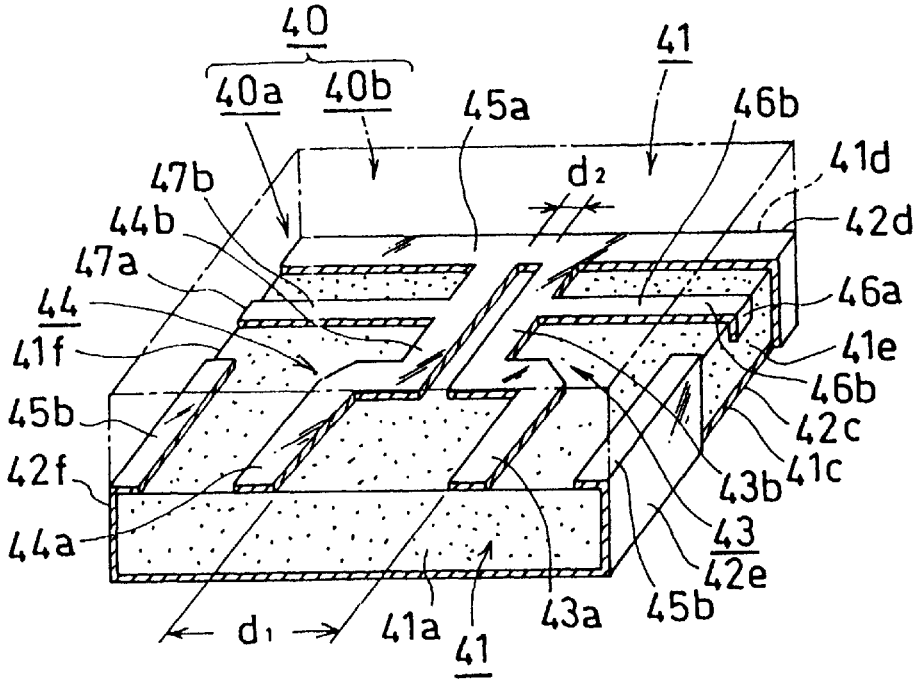
Fig. 1(a) PRIOR ART
FIG. 1 comprise diagrammatic views of a conventional surface mount filter, wherein FIG. 1(*a*) is a perspective diagram showing the surface mount filter and FIG. 1(*b*) is a perspective view showing the surface mount filter surface-mounted on a printed circuit board.
Figure 1B:
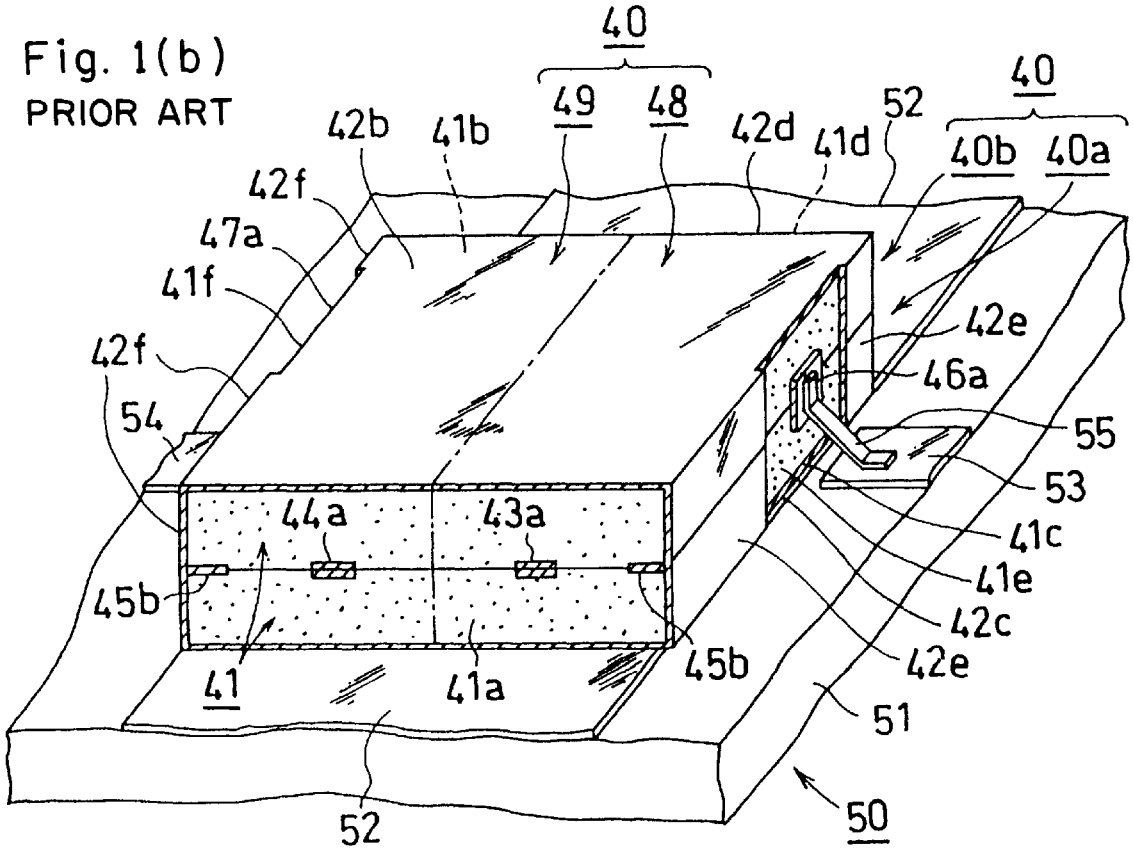
Fig. 1(b) PRIOR ART
Figure 2A:
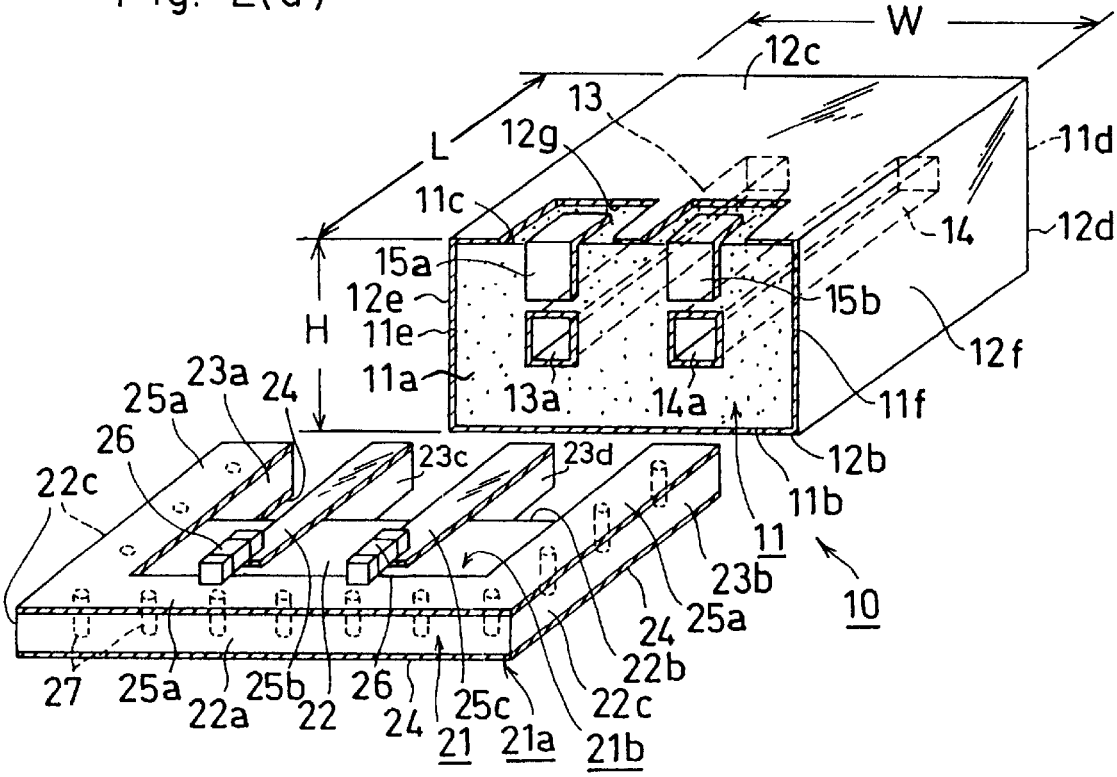
FIG. 2 comprise diagrammatic views showing a surface mount filter according to a preferred embodiment of the present invention, wherein FIG. 2(*a*) is an exploded perspective view thereof and FIG. 2(*b*) is an assembly perspective view thereof.
Figure 2B:
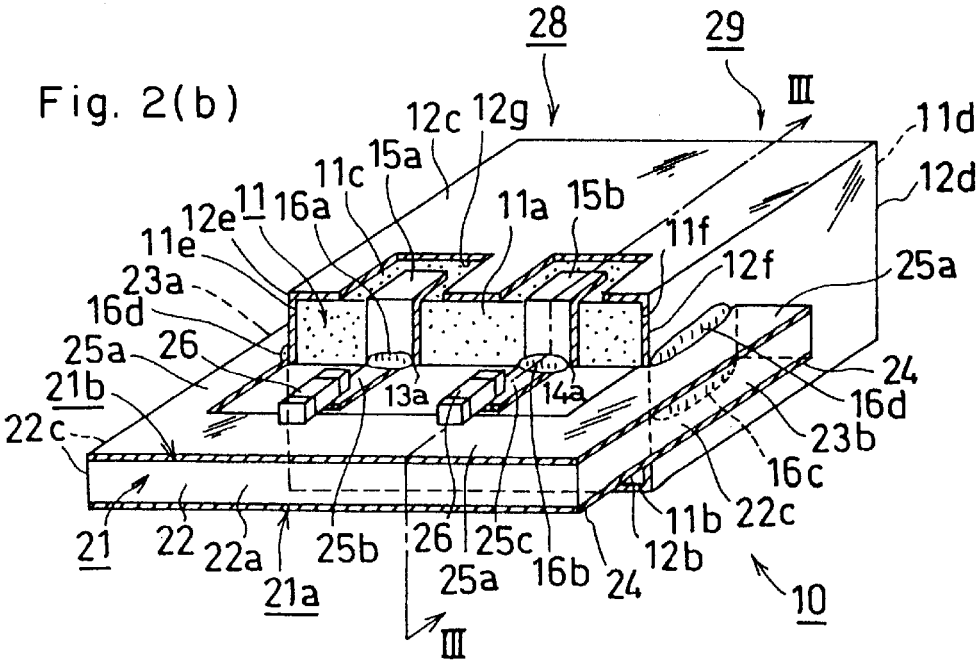
Figure 3A:
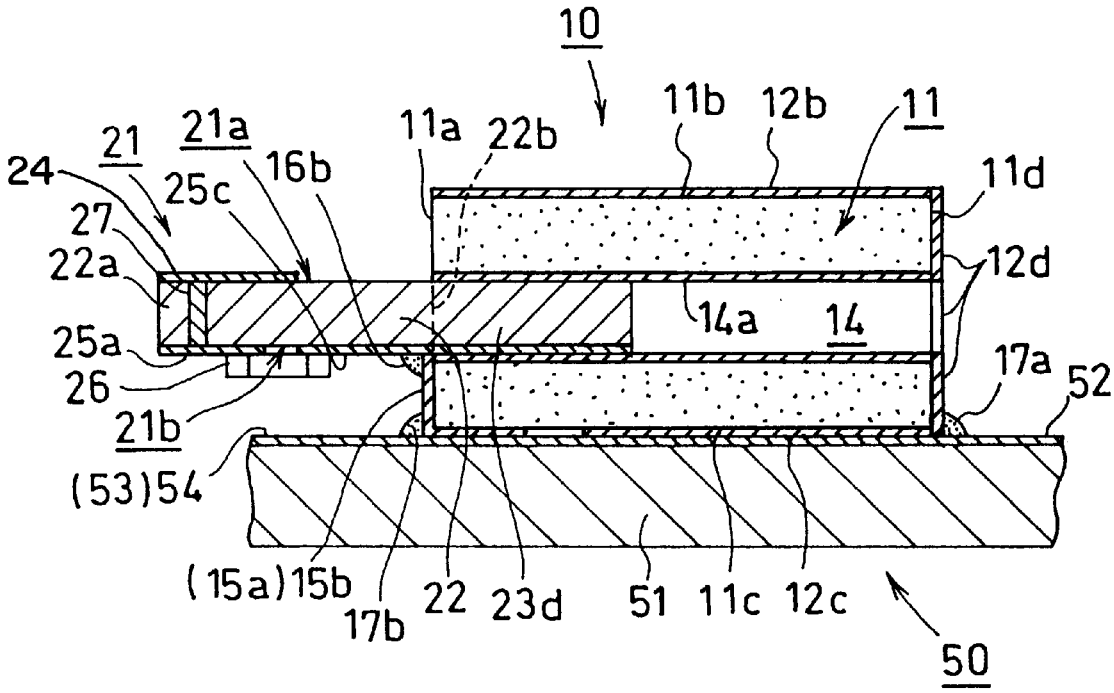
FIG. 3(*a*) is a diagrammatic sectional view showing a surface mount filter surface-mounted on a printed circuit board according to a preferred embodiment and FIG. 3(*b*) is a top view showing a low dielectric constant substrate.
Figure 3B:
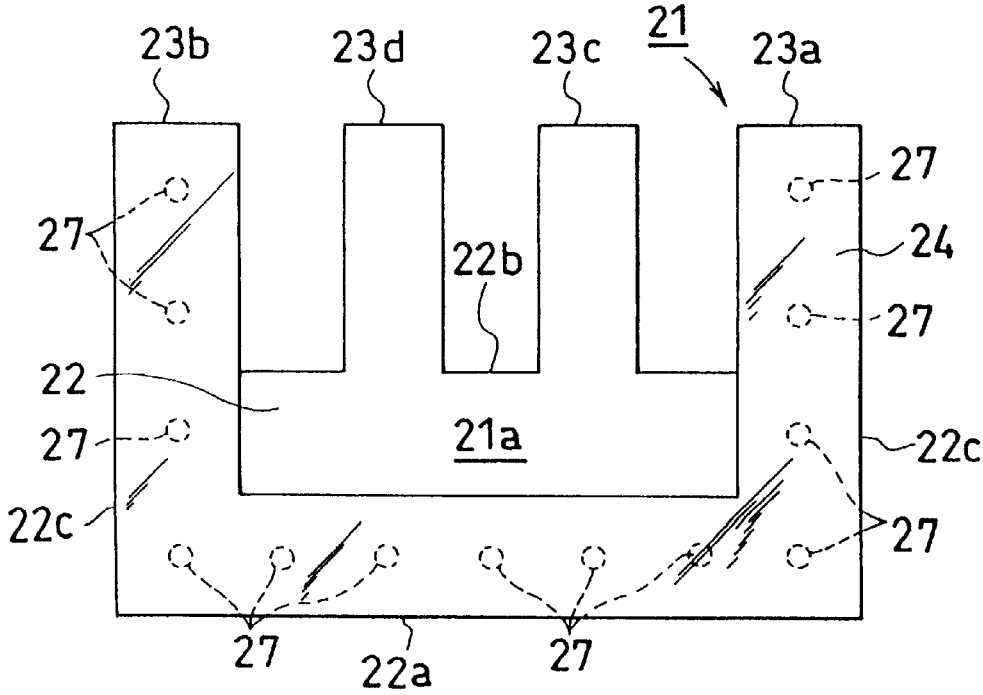

FIG. 2 comprise diagrammatic views showing a surface mount filter according to one embodiment. FIG. 2(*a*) is an exploded perspective view thereof and FIG. 2(*b*) is an assembly perspective view thereof. FIG. 3(*a*) is a sectional view showing a section along line III—III of the surface mount filter in FIG. 2(*b*) and a printed circuit board on which the surface mount filter is mounted and FIG. 3(*b*) is a top view showing a low dielectric constant substrate.

A dielectric block 11 is formed from a material having a high dielectric constant $\epsilon_2$ in the shape of a rectangular parallelepiped with width W, length L, height H. On one main surface 11*b*, another main surface 11*c*, rear surface 11*d*, and side surfaces 11*e* and 11*f* thereof, conductive external electrodes 12*b*–12*f* are continuously formed. Inside the dielectric block 11, through holes 13 and 14, which are square-shaped in a front view, are formed almost in parallel from the front surface 11*a* toward the rear surface 11*d*. On the inner surfaces of the through holes 13 and 14, conductive films 13*a* and 14*a* are formed. The rear ends of the conductive films 13*a* and 14*a* are grounded through the external electrode 12*d*, respectively, while the front ends thereof are open. At prescribed places of the forward portion of the external electrode 12*c*, two notches 12*g* are formed. Almost L-shaped input/output terminals 15*a* and 15*b*, which extend from the other main surface 11*c* within the notches 12*g* to prescribed places of the front surface 11*a* of the dielectric block 11, are formed. End portions of the input/output terminals 15*a* and 15*b* are arranged near the front ends of the conductive films 13*a* and 14*a*, respectively.

On the other hand, a low dielectric constant substrate 21 includes a substrate body 22 which is almost rectangular parallelepiped board-shaped, with plural projections 23*a*–23*d* extending from the rear surface 22*b* of the substrate body 22. The low dielectric constant substrate 21 is formed from a glass epoxy resin, which makes the relationship between the dielectric constant $\epsilon_1$ of the low dielectric constant substrate 21 and the dielectric constant $\epsilon_2$ of the dielectric block 11 $\epsilon_1<\epsilon_2$, and almost in the shape of a comb. An almost U-shaped conductive film 24 is formed over almost all of one main surface 21*a* of the substrate body 22 and the projections 23*a* and 23*b* (FIG. 3(*b*)). On the other hand, on the other main surface 21*b* in the vicinities of the front surface 22*a* and side surfaces 22*c* of the substrate body 22 and the projections 23*a* and 23*b*, an almost U-shaped conductive film 25*a* is formed. On the other main surface 21*b* of the projections 23*c* and 23*d* and the elongated portions toward the substrate body 22 thereof striplines 26*b* and 25*c* are formed, respectively. The front end portions of the striplines 25*b* and 25*c* and the conductive film 25*a* are connected through chip capacitors 26, and the conductive films 25*a* and 24 are connected by way of plural through holes 27.

As shown in FIG. 2(*b*), where the dielectric block 11 and the low dielectric constant substrate 21 are assembled, the projections 23*c* and 23*d* are inserted into the through holes 13 and 14, respectively. The rear surface 22*b* of the substrate body 22 and the front surface 11*a* of the dielectric block 11 are in contact, and the inside surfaces of the projections 23*a* and 23*b* are in contact with the external electrodes 12*e* and 12*f* respectively. The striplines 25*b* and 25*c*, the conductive films 13*a* and 14*a*, and the first ends of the input/output terminals 15*a* and 15*b* are connected by solders 16*a* and 16*b*. The external electrodes 12*e* and 12*f* and the conductive film 24 are connected by a solder 16*c*, while the external electrodes 12*e* and 12*f* and the conductive film 25*a* are connected by a solder 16*d*. A surface mount filter 10 includes the dielectric block 11, external electrodes 12*b*–12*f*, through holes 13 and 14, conductive films 13*a*, 14*a*, 24, and 25*a*, low dielectric constant substrate 21, striplines 25*b* and 25*c*, chip capacitors 26, and associated parts.

In the manufacture of the surface mount filter 10 having the above construction, the dielectric block 11 having prescribed dimensions is first formed by molding and sintering a prescribed ceramic. The through holes 13 and 14 inside the dielectric block 11 are formed using molds simultaneously with the molding of the dielectric block 11. Then, printing and baking or plating and baking, using Cu or Ag for forming the external electrodes 12*b*–12*f* and the input/output terminals 15*a* and 15*b*, are conducted on prescribed places on the surfaces of the dielectric block 11, while the conductive films 13*a* and 14*a* are formed inside the through holes 13 and 14 by Ag plating.

When Cu is used, ordinarily all of the surfaces of the dielectric block 11 are plated, and two surfaces thereof are polished so as to remove the unnecessary plating films. Then, the printing of Cu paste for forming the input/output terminals 15*a* and 15*b*, and the external electrode 12*c* for grounding is conducted, and sintering in a reducing atmosphere is further conducted.

On the other hand, when Ag is used, Ag paste is deposited on all of the surfaces of the dielectric block 11 by dipping and is baked, and two surfaces thereof are polished so as to remove the Ag films. Then, the printing of Ag paste for forming the input/output terminals 15*a* and 15*b* and the external electrode 12*c* for grounding is conducted. Alternatively, after masking one surface of the dielectric block 11, the Ag paste is deposited by dipping and baked, and another surface thereof is polished so as to remove the Ag film. Then, the printing of Ag paste for forming the input/output terminals 15*a* and 15*b* and the external electrode 12*c* for grounding is conducted.

Meanwhile, a glass epoxy resin board with prescribed dimensions, having Cu films formed on both surfaces thereof for forming the low dielectric constant substrate 21, is prepared, and the projections 23*a*–23*d*, and perforations for forming the through holes 27, are formed by punching. Then, etching for forming the conductive films 24 and 25*a* and the striplines 25*b* and 25*c* is conducted on prescribed places on the surface of the low dielectric constant substrate 21, while Cu plating is conducted for forming the through holes 27.

The surface mount filter 10 is manufactured by inserting the projections 23*c* and 23*d* into the through holes 13 and 14 until the rear surface 22*b* of the substrate body 22 comes into contact with the front surface 11*a* of the dielectric block 11, and then connecting the striplines 25*b* and 25*c* to the conductive films 13*a* and 14*a*, and the conductive films 24 and 25*a* to the external electrodes 12*e* and 12*f*, with the solders 16*a*–16*d*.

As shown in FIG. 3, the surface mount filter 10 can be mounted onto a printed circuit board 50 by placing the surface mount filter 10 on the printed circuit board 50 with one main surface 21*a* of the low dielectric constant substrate 21 facing up, connecting a ground electrode 52 to the external electrode 12*c* with solder 17*a*, and connecting input/output signal lines 53 and 54 to the input/output terminals 15*a* and 15*b* by a solder 17*b*. Then, by trimming electrodes of the chip capacitors 26 using a minirouter (an electric drill having a diamond grindstone on its tip) or the like, and observing with a measuring instrument that is additionally connected, the filter characteristics are regulated.

Figure 4:
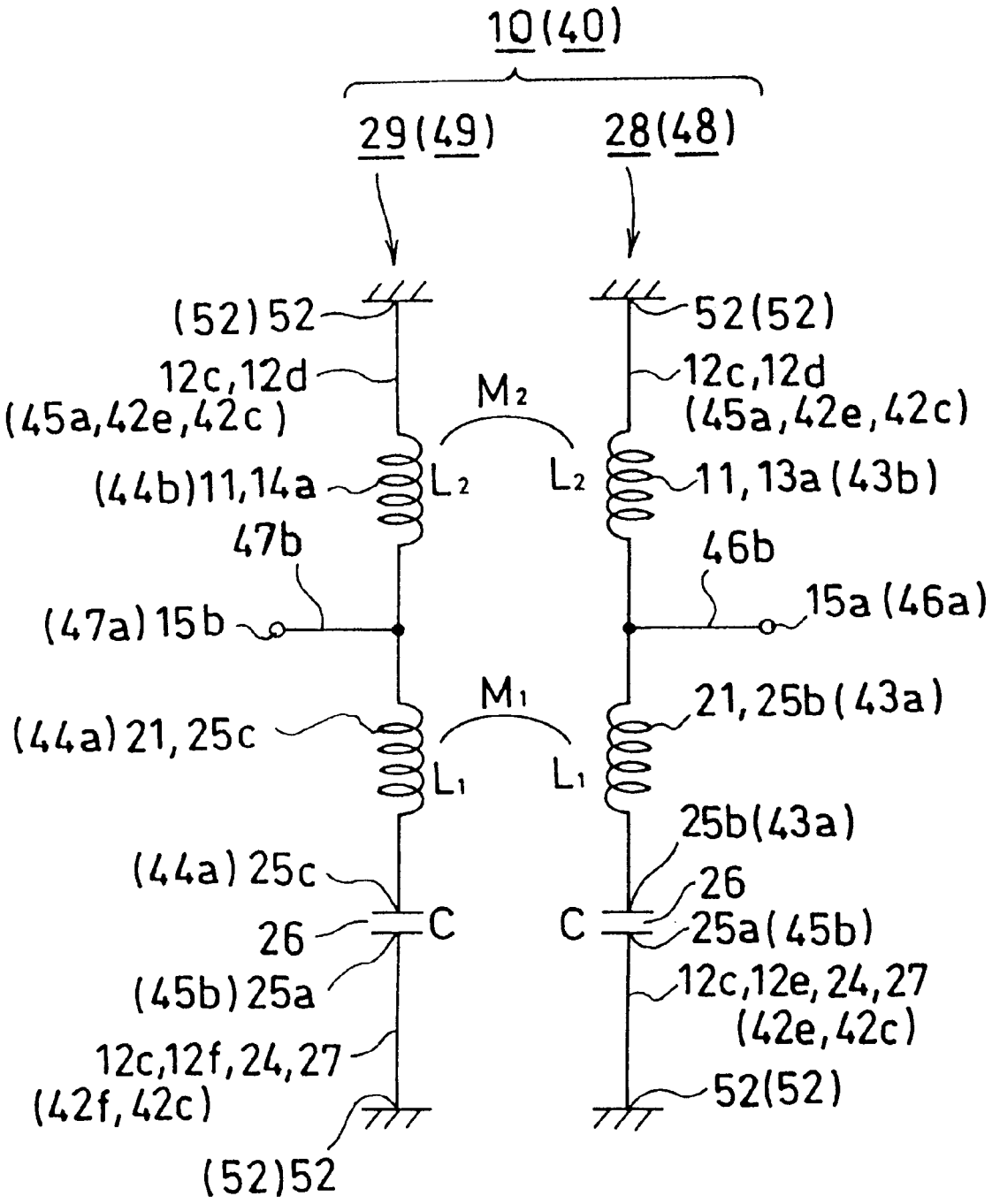
FIG. 4 is a schematic circuit diagram showing an equivalent circuit for a conventional surface mount filter and for a surface mount filter according to an embodiment of the present invention.

FIG. 4 is a schematic circuit diagram showing an equivalent circuit for the surface mount filter 10. Two inductances $L_1$ comprise the low dielectric constant substrate 21 and the striplines 25*b* or 25*c*. To the first end of each inductance $L_1$ is connected capacitance C comprising the chip capacitor 26 and a coupling capacitor between the stripline 25*b* or 25*c* and the conductive film 25*a*. Each capacitance C is connected to the ground electrode 52 through the through hole 27, conductive film 24, external electrodes 12*e* or 12*f*, and 12*c*, and the like.

On the other hand, to the second ends of the two inductances $L_1$ are connected the first ends of inductances $L_2$ comprising the dielectric block 11 and the conductive film 13*a* or 14*a*. The second end of each inductance $L_2$ is connected to the ground electrode 52 through the external electrodes 12*d* and 12*c*. Between the inductances $L_1$ and $L_2$ is connected the input/output terminal 15*a* or 15*b*.

A quarter wavelength resonator 28 includes the dielectric block 11, conductive film 13*a*, input terminal 15*a*, low dielectric constant substrate 21, stripline 25*b*, chip capacitor 26, and associated parts, while a quarter wavelength resonator 29 includes the dielectric block 11, conductive film 14*a*, output terminal 15*b*, low dielectric constant substrate 21, stripline 25*c*, chip capacitor 26, and associated parts. The surface mount filter 10 includes those resonators 28 and 29.

In the surface mount filter 10 having the above construction, the inductances $L_1$ form coupling $M_1$, while the inductances $L_2$ form coupling $M_2$. The coupling $M_2$ is based on a high dielectric constant $\epsilon_2$, while the coupling $M_1$ is based on a low dielectric constant $\epsilon_1$. Since the relationship between $M_1$ and $M_2$ is $M_1<M_2$, the electromagnetic coupling between the resonators 28 and 29 is ensured by the balance between $M_1$ and $M_2$. Therefore, a filtering treatment, wherein signals outside a prescribed band width are cut off, is conducted on microwave signals which are input into the input terminal 15*a* in the resonators 28 and 29, so that only the signals within the prescribed band width are output from the output terminal 15*b*.

As is obvious from the above, in the surface mount filter 10 according to the embodiment, the dielectric block 11 in which the conductive films 13*a* and 14*a* exist has a high dielectric constant $\epsilon_2$, while the low dielectric constant substrate 21 on which the striplines 25*b* and 25*c* exist has a low dielectric constant $\epsilon_1$. Therefore, since the relationship between $M_1$ and $M_2$ is $M_1<M_2$, the strong electromagnetic coupling between the two resonators 28 and 29 can be made without widening the distance between the striplines 25*b* and 25*c*. As a result, further miniaturization can be achieved as the harmonic rejection characteristic at a fundamental frequency can be made favorable.

When the surface mount filter 10 is placed on the printed circuit board 50 with one main surface 21*a* of the low dielectric constant substrate 21 facing up, interconnections on the printed circuit board 50 can be directly connected to the input/output terminals 15*a* and 15*b*, and the external electrode 12*c* on the other main surface 11*c*, so that surface mounting can be certainly and easily performed. Though the two striplines 25*b* and 25*c* are in exposed positions, the striplines 25*b* and 25*c* are electromagnetically shielded by the conductive film 24 formed on the one main surface 21*a*. As a result, a different shield means need not be prepared, leading to cost reduction, as noise which comes flying from above can be certainly prevented from entering the two striplines 25*b* and 25*c*.

The low dielectric constant substrate 21 made of a glass epoxy resin is easily molded and processed, and a unit price thereof is low, compared with the dielectric block 11. Therefore, the manufacture cost can be reduced, as the filter characteristics can be easily and certainly regulated.

In the above-described surface mount filter 10, two conductive films 13*a* and 14*a* inside two through holes 13 and 14, and two striplines 25*b* and 25*c* on the surfaces of two projections 23*c* and 23*d* are included, but in another embodiment, three or more through holes and three or more conductive films inside the through holes may be included, while three or more projections and three or more striplines formed on the projection surfaces may be included. In this case, the harmonic rejection characteristic at a fundamental frequency can be made more favorable.

In the above-described surface mount filter 10, the low dielectric constant substrate 21 is made of a glass epoxy resin material having a low dielectric constant $\epsilon_1$, but the material for forming a low dielectric constant substrate 21 is not limited to the glass epoxy resin. Any resin material having a dielectric constant lower than the dielectric constant $\epsilon_2$ of the dielectric block 11 may be used.

In the above-described surface mount filter 10, the striplines 25*b* and 25*c* are connected to the conductive film 25*a* through the chip capacitors 26, but in another embodiment, the striplines 25*b* and 25*c* may be connected to the conductive film 25*a* through air gaps.

EXAMPLES

Measurement results of filter characteristics of the surface mount filter according to an example are described below.

The surface mount filter was manufactured with the below conditions.

| | |
|---|---|
| Constituents of dielectric block | $BaTiO_3 + Bi_2O_3 + Gd_2O_3$ |
| External dimensions thereof | 4 mm (width W) × 4 mm (length L) × 2 mm (height H) |
| Dielectric constant $\epsilon_2$ thereof | 92 |
| Dielectric constant $\epsilon_1$ of glass epoxy resin constituting low dielectric constant substrate | 2.5 |

Figure 5:
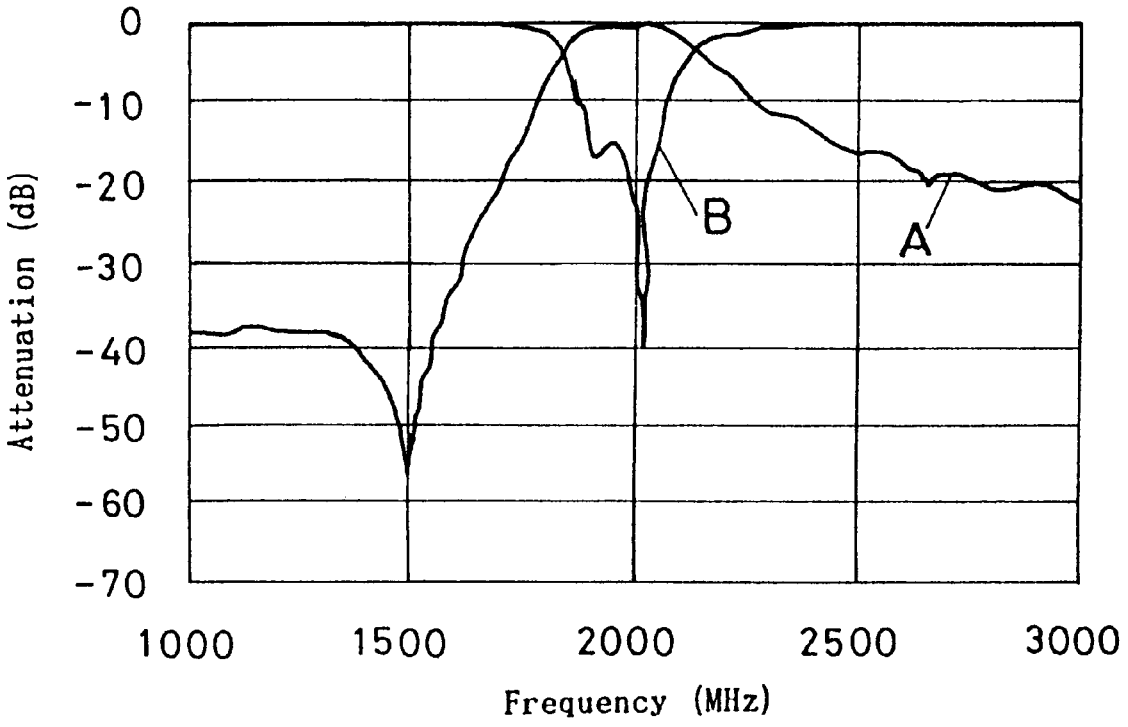
FIG. 5 is a graph indicating measurement results of changes in attenuation at frequencies using a surface mount filter according to an example, where A is a transmission curve of high frequency signals and B is a reflection curve thereof.

FIG. 5 is a graph indicating the measurement results of changes in attenuation at frequencies using the surface mount filter according to the example, where A is a transmission curve of high frequency signals and B is a reflection curve thereof.

As is obvious from FIG. 5, using the surface mount filter according to the example, a trap occurred at about 1500 MHz. A miniaturized narrow-bandpass filter having excellent frequency characteristics of the center frequency of about 2000 MHz and the cut-off frequencies of about 1800–2200 MHz could be obtained.

What is claimed is:

1. A surface mount filter, comprising:

a dielectric block having a high dielectric constant, said dielectric block including:

a plurality of through holes that are coated with conductive films, said through holes having first ends located on one side surface of said dielectric block, and electrodes formed over almost all outer surfaces of said dielectric block except said one side surface; and a low dielectric constant substrate having a conductive film formed over almost all of one main surface and a plurality of striplines formed on another main surface, said striplines having capacitors connected thereto, wherein first ends of said striplines are electrically connected to said through holes and second ends of said striplines are grounded through said capacitors.

2. The surface mount filter of claim 1, wherein:

said outer surfaces of said dielectric block include a printed circuit board connection surface at which said dielectric block is adapted to be connected to a printed circuit board;

said first ends of said striplines are connected to said through holes at respective connection portions; and input and output terminals are provided so as to have first ends connected to two of said connection portions, respectively, and second ends extending onto said printed circuit board connection surface.

3. The surface mount filter of claim 2, wherein said low dielectric constant substrate is made of a glass epoxy resin.

4. The surface mount filter of claim 1, wherein said low dielectric constant substrate is made of a glass epoxy resin.

5. The surface mount filter of claim 1, wherein said plurality of striplines of said low dielectric constant substrate correspond in number to the number of said plurality of through holes in said dielectric block.

6. The surface mount filter of claim 1, wherein said striplines are partially inserted into said through holes and input and output terminals extend from two of said striplines, respectively, along said one side surface.

7. The surface mount filter of claim 1, wherein said striplines and said through holes extend entirely straight and parallel with respect to each other.

8. The surface mount filter of claim 1, wherein said striplines are partially inserted into said through holes.

* * * * *